United States Patent [19]

Abbott et al.

[11] 4,423,645

[45] Jan. 3, 1984

[54] PIPE SPINNER

[75] Inventors: Roderick K. Abbott, Villa Park; Padmasiri D. Seneviratne, Fullerton; Joseph A. R. Picard, Fountain Valley, all of Calif.

[73] Assignee: Varco International, Inc., Orange, Calif.

[21] Appl. No.: 272,328

[22] Filed: Jun. 10, 1981

[51] Int. Cl.[3] ..... F16H 5/52; F16H 3/22; F16H 57/00

[52] U.S. Cl. ..... 74/810; 74/342; 74/404; 173/163

[58] Field of Search ..... 74/810, 341, 342, 664, 74/404, 6; 173/57, 164, 163; 81/57.31, 57.15, 57.16, 57.17, 57.18, 57.20, 57.21

[56] References Cited

U.S. PATENT DOCUMENTS

| | | | |
|---|---|---|---|
| 1,377,575 | 5/1921 | Greve | 173/57 |
| 2,400,712 | 5/1946 | Prather et al. | 81/57.15 |
| 3,025,733 | 3/1962 | Soodnizin | 81/57.16 |
| 3,054,465 | 9/1962 | Fish | 173/57 |
| 3,086,413 | 4/1963 | Mason | 81/57.16 |
| 3,144,085 | 8/1964 | Hasha | 173/164 |
| 3,239,016 | 3/1966 | Alexander | 173/164 |
| 3,272,266 | 9/1966 | Kennard | 173/164 |
| 3,330,164 | 7/1967 | Wilson | 173/163 |
| 3,381,584 | 5/1968 | Bartos | 91/104 |
| 3,390,728 | 7/1968 | Bartos | 173/163 |
| 3,399,576 | 9/1968 | Seilly et al. | 290/38 R |
| 3,461,974 | 8/1969 | Bartos | 173/79 |
| 3,541,897 | 11/1970 | Horton | 81/57.18 |
| 3,592,570 | 7/1971 | Bartos | 173/57 |
| 3,625,095 | 12/1971 | Barnett et al. | 173/164 |
| 3,635,105 | 1/1972 | Dickmann et al. | 81/57.18 |
| 3,875,826 | 4/1975 | Dreyfuss et al. | 81/57.18 |

*Primary Examiner*—Leslie A. Braun
*Assistant Examiner*—Bruce F. Wojciechowski
*Attorney, Agent, or Firm*—William P. Green

[57] ABSTRACT

A spinner for turning a well drilling kelly or the like and including a member connectible to the kelly to drive it rotatively, a reversible motor, and a drive between the rotor of the motor and said member including two gears for driving the member in opposite directions respectively, with the two gears being mounted by threaded connections for axial movement between active driving positions and retracted non-driving positions. Rotation of the motor acts by virtue of a threaded connection or connections to shift one of the gears to its active driving position to turn the driven member in a first direction, while retaining the second of the gears in its retracted position. Rotation of the motor in the opposite direction acts to shift the second of the gears to active position driving the member in its second direction while retracting the first of the gears to its inactive position.

32 Claims, 10 Drawing Figures

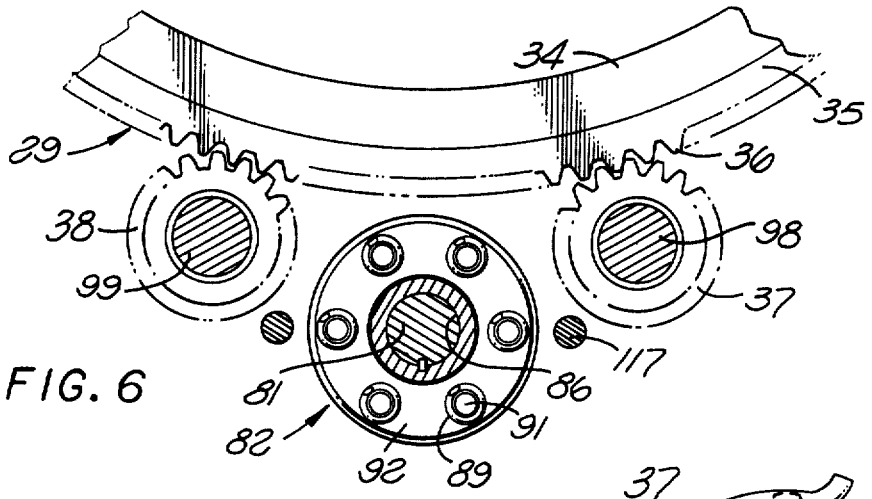
FIG. 6
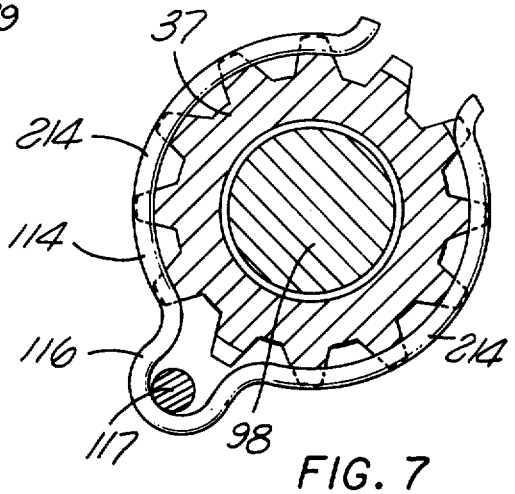
FIG. 7
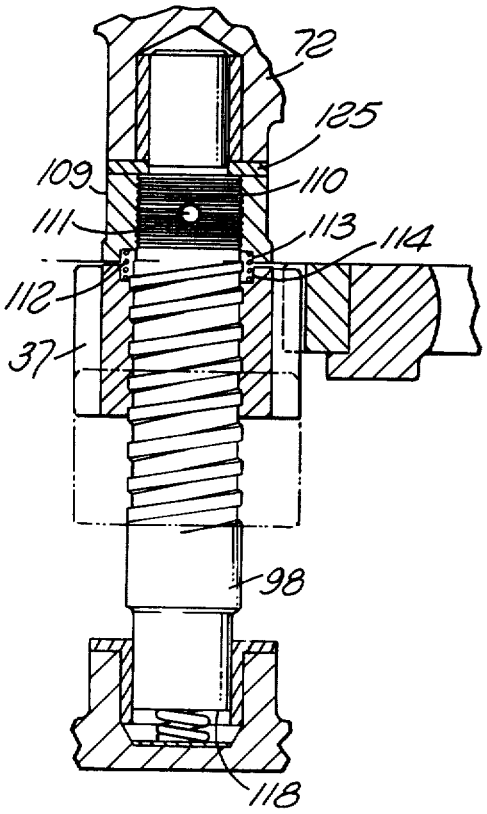
FIG. 5
FIG. 8
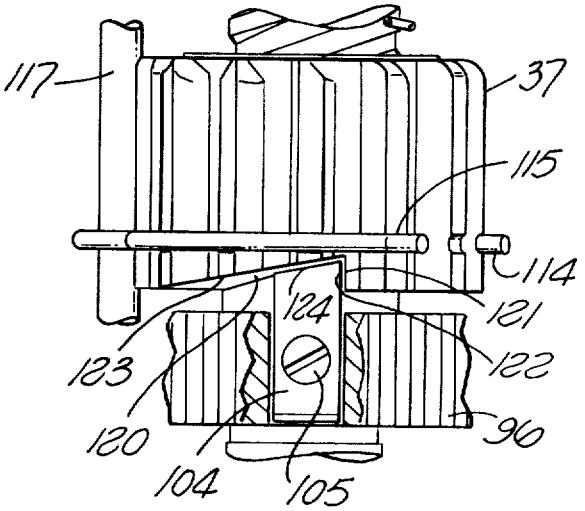

PIPE SPINNER

BACKGROUND OF THE INVENTION

This invention relates to drive arrangements for turning a drive member in opposite directions. Certain aspects of the invention are particularly adapted for spinning a well drilling kelly to attach it to or detach it from another well pipe section. The invention will be discussed primarily as applied to that use.

Kelly spinners embodying the present invention are of a known general type adapted to be connected into the drill string at a location above the kelly and beneath the swivel, and acting to spin the kelly in either direction relative to the body of the swivel. Such spinners have been shown in various prior art patents, including for example U.S. Pat. No. 3,144,085. One arrangement illustrated in that patent includes two motors for turning a driven member in opposite directions, with each of the motors acting through a gear which upon energization of the associated motor is shiftable axially from a retracted position to an active position of engagement with a coacting driven gear. The drive gears may be mounted movably by two threaded connections which cause the discussed axial shifting movement of the gears when the motors are turned. Another arrangement shown in U.S. Pat. No. 3,144,085 utilizes a reversible motor having a single gear which is shifted axially by pressure fluid between active and retracted positions. Another similar device is shown in U.S. Pat. No. 3,390,728.

SUMMARY OF THE INVENTION

A purpose of the present invention is to provide a spinner which is very simple in structure and operation and is completely reliable in its conversion from a condition of powered rotation in one direction to a condition of rotation in the opposite direction, and which does not rely upon hydraulic or pneumatic actuation of a drive gear or drive gears to reverse the direction of rotation. Also, as in the prior devices of the above-discussed patents, a unit embodying the present invention automatically acts to disconnect the drive motor means from the driven member in an inactive condition of the spinner in which the drill string may be turned by a conventional rotary table.

A spinner constructed in accordance with the invention utilizes a single reversible motor which when driven in one direction acts through a first drive gear to turn a driven member in a predetermined direction, and when driven in the opposite direction acts through a second drive gear to turn the same driven member in its opposite direction. The two drive gears are mounted by threaded connection means for automatic axial shifting movement between active driving positions and retracted non-driving positions in response to rotation of the motor. That is, when the motor turns in one direction a first of the gears is automatically shifted axially to an active driving position and then functions to drive a coacting additional gear, while the same rotation of the motor acts to automatically retain the second of the drive gears in its retracted position, or in the event of a hang-up to forcibly displace that second gear to inactive position. Reverse rotation of the motor has the opposite effect of shifting the second drive gear to its active position and retaining the first mentioned gear in its retracted position or actuating it to that position. In one form of the invention, the lead screw threads which cause such axial shifting movement of the drive gears are external threads on two separate shafts engaging internal threads of the gears. The thread on one of the shafts is desirably a right-hand thread, while the other shaft has a left-hand thread. In another arrangement, a single lead screw or other threaded element mounts and actuates both of the drive gears.

BRIEF DESCRIPTION OF THE DRAWINGS

The above and other features and objects of the invention will be better understood from the following detailed description of the typical embodiments illustrated in the accompanying drawings, in which:

FIG. 5 is a vertical section on line 5—5 of FIG. 4;

FIG. 6 is a horizontal section on line 6—6 of FIG. 4;

FIG. 7 is a fragmentary horizontal section taken on line 7—7 of FIG. 4;

FIG. 8 is a fragmentary view taken on line 8—8 of FIG. 4;

DESCRIPTION OF THE PREFERRED EMBODIMENTS

Figure 1:
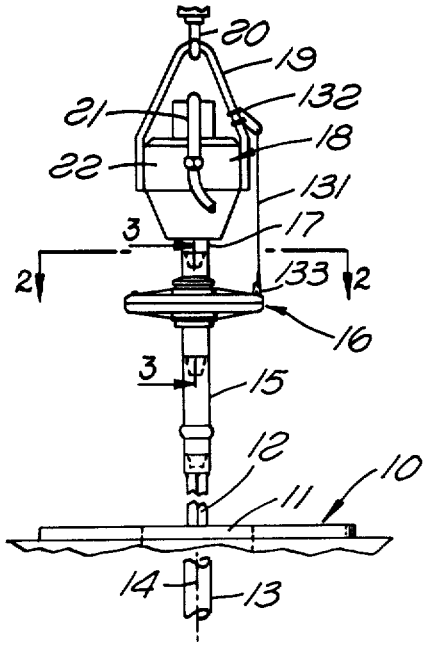
FIG. 1 is a diagrammatic representation of a portion of a well drilling rig including a kelly spinner constructed in accordance with the invention.
Figure 2:
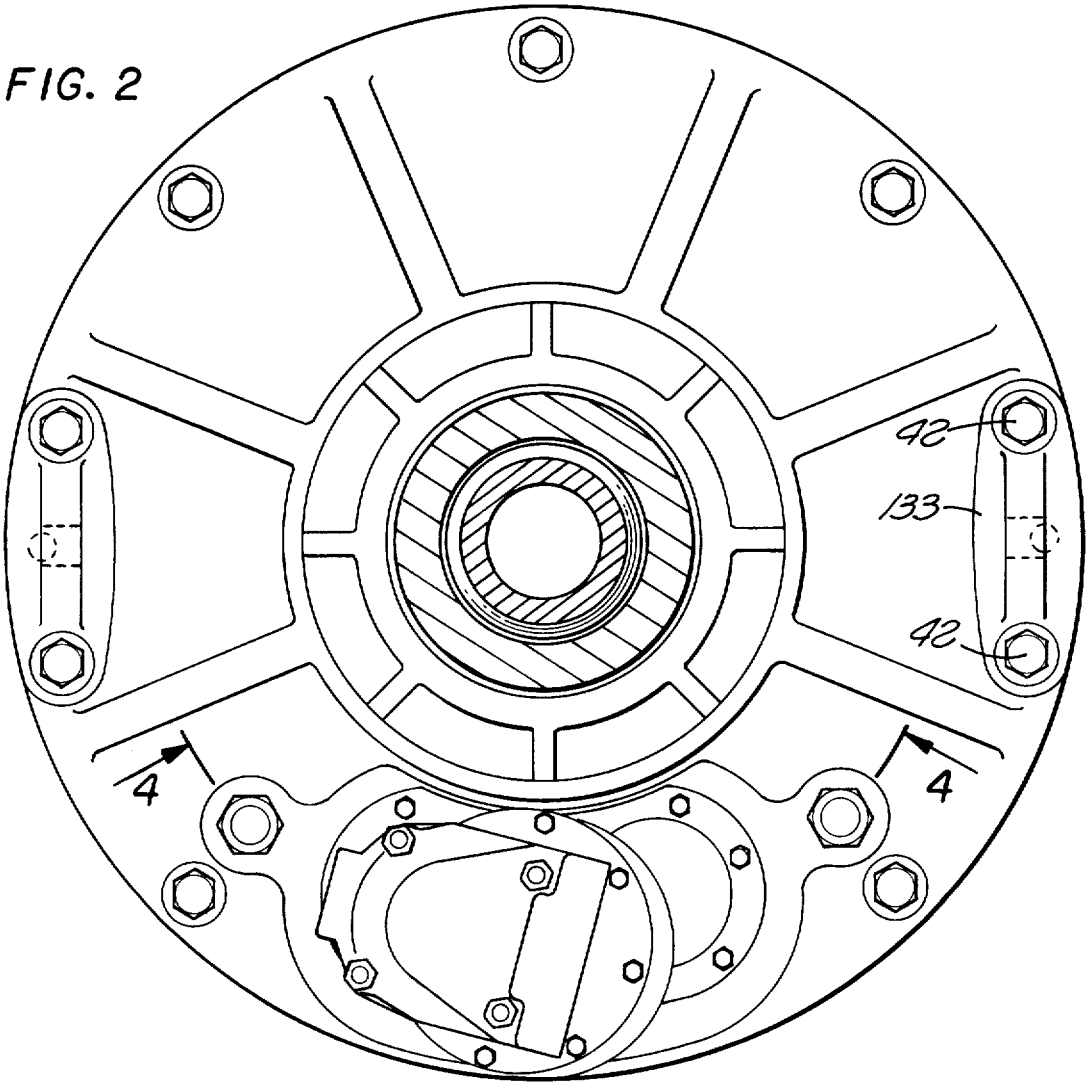
FIG. 2 is an enlarged plan view of the spinner taken on line 2—2 of FIG. 1.

The well drilling rig illustrated fragmentarily in FIG. 1 includes a conventional rotary table 10 containing a master bushing and kelly bushing assembly 11 through which a conventional kelly 12 of externally square horizontal section extends in a relation driving the kelly 12 and the remainder of a drill string 13 connected thereto rotatively about the vertical axis 14 of the well. The kelly may be connected at its upper end to a kelly cock section 15, which is in turn threadedly connected to and suspended by a kelly spinner 16 formed in accordance with the invention. The upper end of the kelly spinner is connected to and suspended by the tubular rotatable section 17 of a conventional swivel 18, whose bail 19 is suspended by the hook 20 of a traveling block operable to raise and lower the swivel and other suspended parts including the drill string as drilling progresses. Circulating fluid is pumped into the upper end of the swivel through a gooseneck 21 carried by the nonrotating section 22 of the swivel, and flows downwardly through the rotating tubular section 17 of the swivel and through the spinner and kelly into the drill string.

The spinner includes a central tubular shaft 23 which is externally cylindrical along most of its vertical extent, and contains a vertical cylindrical passage 24 communicating at its upper end with the rotary stem 17 of the swivel and communicating at its lower end with kelly cock section 15 and the passage within kelly 12. An externally threaded pin portion 25 at the lower end of shaft 23 is threadedly connectible into an internally threaded box portion 26 of the kelly cock. Similar internal threads 27 at the upper end of shaft 23 are adapted to receive and form a connection with the external threads of a lower pin end 28 of the swivel stem 17.

The shaft 23 of the spinner is driven rotatively about axis 14 through a ring gear 29 which extends about the shaft and is rigidly connected thereto. The inner cylindrical surface 30 of the ring gear is a close fit on an external cylindrical surface 31 of the shaft, with the gear being retained against rotation relative to the shaft by a key 32 received within opposed keyway grooves 33 in parts 23 and 29. The ring gear structure may be formed in two sections including an inner part 34 and an outer annular gear element proper 35 appropriately attached by welding, lock screws, or other means in fixed position relative to the inner element. The outer gear part has a series of circularly spaced teeth 36 adapted to mesh with teeth of a pair of pinion gears or drive gears 37 and 38 operable to rotate gear 29 in opposite directions respectively.

The pinion gears 37 and 38 and other related parts are mounted about shaft 23 by a body structure 39, formed primarily of an upper body section 40 and a lower body section 41, secured together by a series of circularly spaced bolts 42 and associated nuts 43 which clamp opposed faces of the two sections together in sealed relation at annular surfaces 44 between which a gasket 45 is received. The seal at gasket 45 coacts with upper and lower seals 46 and 47 carried by the body to prevent escape of lubricant from an inner essentially annular chamber 48 in the body forming a bath lubricating the gears and related bearings and other parts.

The body 39 is carried about shaft 23 by means of a pair of upper and lower oppositely inclined thrust type bearings 49 and 50, whose inner races 51 and 52 are clamped in fixed positions on shaft 23 and whose outer races 53 and 54 are fixed against rotation relative to body parts 40 and 41. A bearing loading ring 55 above the upper thrust bearing 49 may be retained against upward movement by a snap ring 56 received within a groove in the outer surface of shaft 23, and may carry a series of vertical set screws 57 threadedly connected to ring 55 and adjustable to exert downward force against the inner race of bearing 49, to clamp that bearing and ring gear 29 and the inner race 52 of lower bearing 50 downwardly against an annular shoulder 58 formed on shaft 23 to thus connect the ring gear and bearings to the shaft in fixed relative positions. Lock nuts 59 carried by the set screws may lock them in a desired clamping condition.

The upper seal ring 46 may be of any conventional type capable of forming an effective fluid tight seal between the interior and exterior of the body, and may be carried by and between two annular parts 60 and 62, the first of which may be secured to the upper body section 40 by bolts 61 and the second of which may be secured by a set screw or set screws 63 to the shaft for rotation therewith, with the seal ring 46 forming an effective annular seal between the relatively rotating parts 60 and 62. The lower seal ring 47 is typically illustrated as forming a seal between an annular part 64 secured by bolts 65 to lower body section 41 and an outer cylindrical seal surface 66 formed on the shaft. A plug 67 may be utilized for filling lubricant into the interior of the body structure.

The gears are powered by a reversible motor 68, which may be energized by any convenient source of power, and more particularly is preferably either a hydraulic motor or a pneumatic motor but may also be electrically operated if desired. The housing of the motor is rigidly secured to the body of the spinner, typically by means of a number of bolts 69 securing the motor housing to an adapter plate 70, which in turn may be secured by bolts 71 to an upper drive case 72 secured by bolts 73 to upper section 40 of the body, with gaskets being provided between the various parts to maintain the sealed condition of the interior of the body. The top body section 40 may contain an opening 74 at the location of the motor and related parts, to allow the motor to drive the inner gears. A lower gear case 75 may similarly be secured by bolts 76 to the bottom section 41 of the body at the location of an opening.

The rotor 78 of the motor drives a shaft 79 rotatively about a vertical axis 80. Shaft 79 is in turn rigidly connected to and drives an aligned shaft 81 of a slip clutch 82 which may be of any conventional type capable of transmitting power from the motor to the gears up to a certain torque and then slipping beyond that torque to prevent damage to the motor and gears. The shaft 81 of the slip clutch may have an upper annular cup shaped portion 83 received about the lower end of motor shaft 79 and retained against rotation relative thereto by a key or keys 84. The lower end of shaft 81 of the slip clutch is centered for rotation about axis 80 by a bottom bearing 85 carried by the lower case member 75.

The slip clutch is typically illustrated as of a known type including a tubular part 86 extending about and keyed to shaft 81 for rotation therewith, a second annular part 87 carried rotatively about shaft 81, and a stack of thin friction rings 88 received radially between parts 86 and 87 and clamped together by the force of a series of circularly spaced coil springs 89 interposed between an axially adjustable backing ring 90 and the friction rings. A number of pins 91 may be carried by an annular pressure plate 92 above the friction rings for locating the springs. Alternate ones of the friction rings 88 are splined to inner part 86 for rotation therewith, while the other friction rings therebetween are splined to outer part 87 to rotate with it. Downward movement of the friction rings is prevented by engagement of a lower backing ring 93 with a shoulder 94 formed on part 86.

Figure 4:
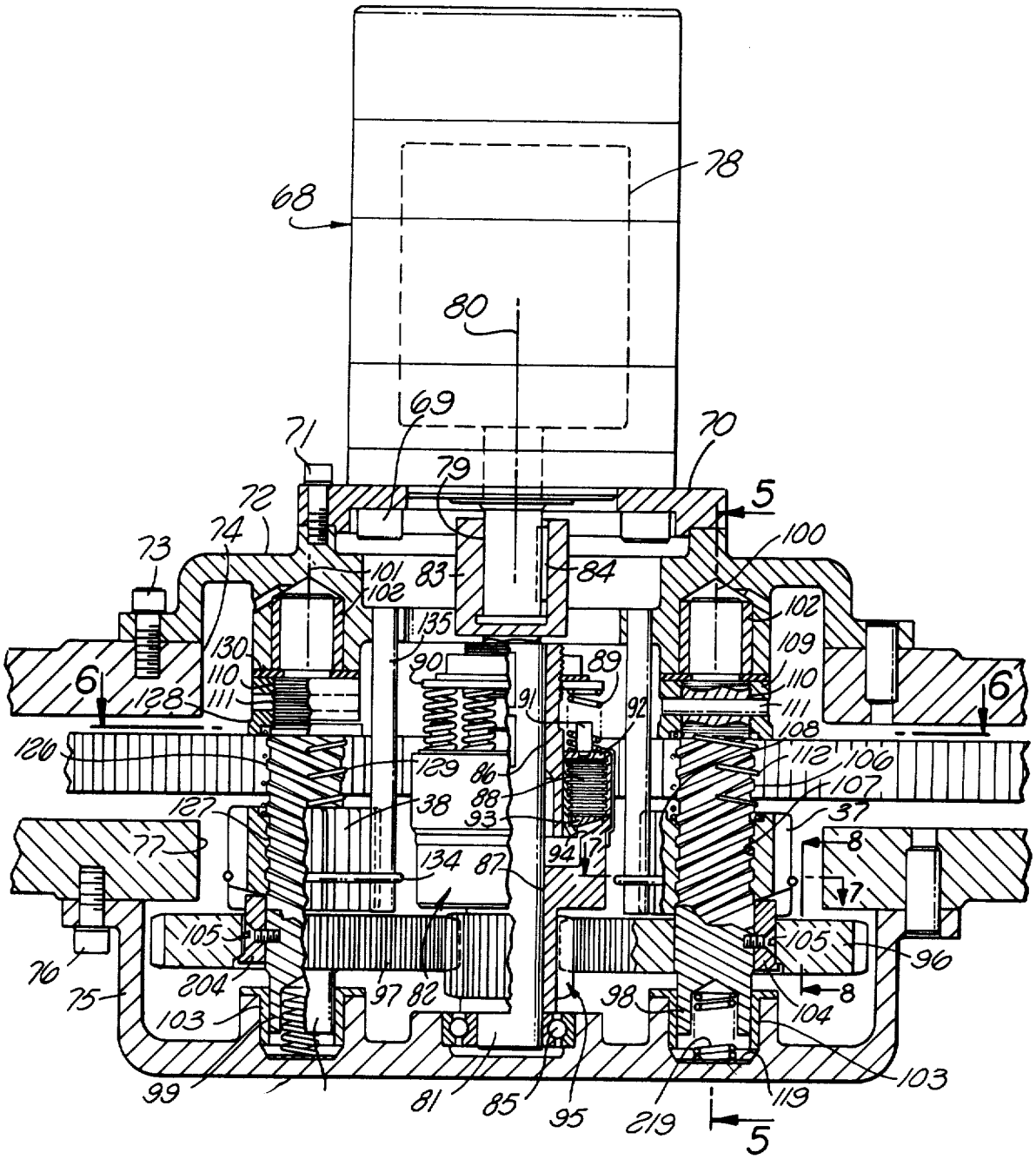
FIG. 4 is a vertical section on line 4—4 of FIG. 2.

The output element 87 of the slip clutch has a portion at its lower end shaped to form a series of circularly spaced teeth forming a gear 95 which meshes with and drives two identical reduction gears 96 and 97 for turning the pinion gears 37 and 38. Gears 96 and 97 are secured rigidly to two vertical shafts 98 and 99 journaled for rotation about two parallel vertical axes 100 and 101 by upper and lower bearings 102 and 103 carried by the two drive cases 72 and 75. Gears 96 and 97 are fixed against rotation relative to shafts 98 and 99 by a pair of keys 104 and 204 secured by set screws 105 to the shafts and received within keyways in the gears. As seen in FIG. 4, the keys project upwardly a short distance above gears 96 and 97, to act as stops for limiting rotational movement of pinion gears 37 and 38 relative to shafts 98 and 99.

Above gear 96, shaft 98 has an external thread 106 of rapid pitch engaging a corresponding internal thread 107 in pinion gear 37 in a relation causing upward advancement of the pinion gear along shaft 98 in response to clockwise rotation of the shaft as viewed looking downwardly along axis 100. Upward movement of gear 37 along the shaft is limited by engagement of an upper surface 108 on the gear with the undersurface of a stop ring 109 carried by a shaft. This ring 109 may be connected to the shaft by threads 110, and be retained against rotation relative to the shaft by a pin 111 extending diametrically through aligned openings in the shaft and ring 109. A coil spring 112 is interposed between ring 109 and pinion gear 37, to yieldingly urge the latter downwardly, and in the uppermost position of the pinion gear is received entirely within two opposed annular grooves 113 and 114 in ring 109 and the gear. The force exerted by spring 112 is sufficiently light to be overcome by the tendency for upward movement of pinion gear 37 in response to the discussed clockwise rotation of shaft 98 as viewed looking downwardly along axis 100. When the shaft is rotated in that clockwise direction, the inertia of pinion gear 37 resists corresponding rotation of that gear, and thus causes the gear to screw upwardly along the shaft to the full line position of FIG. 5 in which gear 37 engages and drives ring gear 29 and the main vertical shaft 23 of the spinner. In the lower retracted or inactive position of FIG. 4, pinion gear 37 is completely out of engagement with the ring gear and thus does not drive it.

If the rotation of shaft 97 commences fairly abruptly and rapidly, the inertia of pinion gear 37 will by itself cause the above discussed upward axial shifting movement of the pinion gear to its active driving position. If, however, the motor 68 is energized more slowly and the shaft therefore turns relatively slowly, the inertia of gear 37 may not by itself be sufficient to cause its upward shifting movement. To assure upward movement of gear 37 in that event, means are provided for supplementing the resistance of gear 37 for rotation. For this purpose, a friction element 114 may be utilized, and may take the form of a generally annular spring element received within an annular groove 115 in a lower portion of gear 37 and frictionally engaging the gear to resist its rotation. A radially outwardly projecting portion 116 of the spring element extends about a vertical pin 117 which is secured to and projects downwardly from upper drive case 72 of the spinner, so that pin 117 retains element 114 against rotation about axis 100, and the engagement of element 114 with gear 37 then frictionally resists rotation of the gear. Spring 114 has two arcuately curving portions 214 which are received within groove 115 and which tend by their resilience to return to a diameter smaller than that of groove 115 to thereby yieldingly press portions 214 radially inwardly against the inner wall of the groove and assure the desired frictional resistance to rotation of the gear. In order to facilitate engagement of gear 37 with ring gear 29 upon upward movement of gear 37, the shaft 98 is mounted for limited downward axial movement relative to body parts 40 and 41 and ring gear 29. For this purpose, the lower end 118 of shaft 98 terminates at a location spaced above a bottom thrust washer 119 carried in lower drive case 75, with a coil spring 219 acting downwardly against the thrust washer and upwardly against shaft 98 to normally retain it in its upper position. If gear 37 upon upward movement relative to the shaft does not exactly mesh with the teeth of ring gear 29, shaft 98 may move downwardly a short distance against the tendency of spring 219 to enable further slight upward movement of pinion gear 37 relative to the shaft in a manner turning the gear just enough to properly engage its teeth with those of the ring gear.

As previously indicated the key 104 associated with shaft 98 acts to limit downward movement of pinion gear 37 relative to shaft 98. For this purpose, the pinion gear has a notch or recess 120 (FIG. 8) defining a vertical shoulder 121 against which a vertical shoulder 122 of key 104 is engagable to halt the downward movement of pinion gear 37 at a position in which it is spaced slightly above gear 96 and will not have a binding engagement therewith. The opposite side of notch 120 may be defined by an inclined surface 123, with key 104 having a correspondingly inclined surface 124 enabling the key to move into and out of the notch as the pinion gear moves vertically. In order to take the upward forces exerted by gear 37 in driving position, a thrust washer 125 may be interposed between ring 109 and part 72.

The shaft 99 associated with gear 38 may be identical with the above discussed shaft 98 except that the external thread 126 formed on the outer surface of shaft 99 is a left-hand thread rather than a right-hand thread, and engaging internal thread 127 in pinion gear 38 may be similarly left-handed. The upper stop ring 128, coil spring 129, friction spring 134, pin 135 and thrust washer 130 may be identical with parts 109, 112, 114, 117 and 125 associated with shaft 98. The key 204 associated with shaft 99 and the mating recess or notch 220 in gear 38 may be similar to the corresponding key 104 and notch 120 associated with shaft 98, but with their vertical shoulders and inclined surfaces (corresponding to shoulders 121 and 122 and inclined surfaces 123 and 124) reversed in order to limit counterclockwise rotation of gear 38 relative to shaft 99 rather than clockwise rotation as in the case of gear 37. Thus, the key and notch engagement limits downward movement of the pinion gear 38 in a position in which it is spaced just slightly above gear 97 to prevent binding contact therewith.

When the spinner 16 of the present invention is in use as illustrated in FIG. 1, the body of the spinner is retained against rotation about the axis of the well. Such retention may be effected by connecting the body of the spinner to the body of swivel 18, as by means of a flexible but inextensible cable 131 connected at its upper end to an anchoring member 132 secured to the bail 19 of the swivel and at its lower end to an eye bracket 133 secured to the body of the swivel. Preferably two such eye brackets are secured to the body at diametrically opposed locations, by two of the bolts 42 which secure the body parts together, so that either or both of these elements may be connected to the swivel body by cables.

During periods when the kelly 12 of FIG. 1 and drill strng 13 are being rotated by rotary table 10 to cause a bit carried at the lower end of string 13 to drill a well, the motor 68 of spinner 16 is not in operation, and the two axially shiftable pinion gears 37 and 38 are in their FIG. 4 non-driving positions in which they do not contact ring gear 29. That ring gear and the main shaft 23 of the spinner can thus turn freely with the remainder of the drill string and with the stem 17 of swivel 18 without rotating the motor or any of the gears except the ring gear itself. There is thus no wear on the motor and related parts while the hole is being drilled. When it becomes desirable to utilize the spinner for turning kelly 12 in order to detach it from or connect it to the drill string, or connect it to or detach it from a section of pipe which is to be added to or removed from the string, the operator supplies pressurized hydraulic fluid or compressed air or other energizing power to motor 68 to cause its rotation in a desired direction. If the motor shaft 79 turns in a clockwise direction as viewed looking downwardly along axis 80, gear 95 at the bottom of slip clutch 82 turns both of the reduction gears 96 and 97 and their connected threaded shafts 98 and 99 in a counterclockwise direction. Pinion gears 37 and 38 tend to resist rotation with the shafts by virtue of the inertia of those gears and their friction spring elements 114 and 134. The relative rotation between shaft 98 and pinion gear 37 acts by virtue of the righthand threaded connection between these parts to exert a downward force on pinion gear 37, effectively retaining it in its retracted position of FIG. 4. The left-hand threads of shaft 99 and gear 38 have the opposite effect on that gear and tend to urge it upwardly from its lower position of FIG. 4 to an upper position of meshing engagement with ring gear 29. When gear 38 reaches its uppermost position of engagement with stop ring 128, further rotation of shaft 99 causes corresponding rotation of gear 38 and therefore effectively drives ring gear 29 and the main shaft 23 of the spinner, as well as the kelly 12 connected thereto. The rotation of the kelly when thus driven by pinion gear 38 is in a clockwise direction as viewed looking downwardly along the main axis of the spinner. If the motor is energized for rotation in the opposite direction, the action of the two threaded shafts is reversed, and pinion gear 37 is actuated upwardly to drive the ring gear and main shaft of the spinner in a counterclockwise direction. Spring 112 like spring 129 does not have enough force to prevent upward movement of gear 37 under the combined effects of inertia and friction element 114 when the motor is started but will return gear 37 downwardly under static conditions. If excessive resistance to rotation of the shaft of the spinner is encountered, slip clutch 82 permits the motor to turn relative to the output of gear 95 of the slip clutch and the other driven elements, to thus avoid damage to either the motor or the gears. When the resistance decreases to a point below the torque for which slip clutch 82 has been set, that clutch then commences again to transmit power through the gear train from the motor and to the spinner shaft. If for any reason one of the pinion gears 37 or 38 becomes stuck or retained by friction or otherwise in its upper position, and does not return downwardly under the influence of its associated spring 112 or 129, operation of motor 68 in a direction to cause the other of the pinion gears to drive the spinner shaft will automatically retract the first mentioned stuck gear to a lower position. The illustrated arrangement thus automatically retracts one pinion gear when the other is actuated to its active driving position to assure against any possibility of simultaneous engagement of both pinion gears with the ring gear 29. Further, each of the pinion gears can be retracted downwardly by driving the rotary table in an appropriate direction, to thereby turn the ring gear relative to the pinion gear which is to be retracted. It is found that the normal sequence in which the kelly spinner and rotary table are operated in making and breaking connections and in drilling is such that whenever during that sequence the kelly is driven by the rotary table it is normally in a direction such as to retract downwardly the pinion gear which was last used in spinning the pipe, thus assuring that pinions 37 and 38 and the motor, clutch and associated gears will not be rotated and subjected to wear during drilling. If for any reason a changed sequence of operation is desired, the operator may purposely see to it that each time the rotary table is placed in operation it is first turned for a short interval in a proper direction to retract downwardly the pinion gear which was last in use for spinning.

Figure 10:
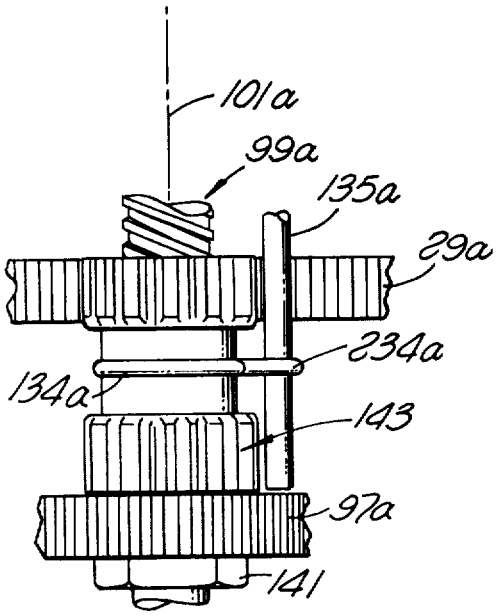
FIG. 10, is a reduced scale fragmentary section on line 10—10 of FIG. 9.
Figure 9:
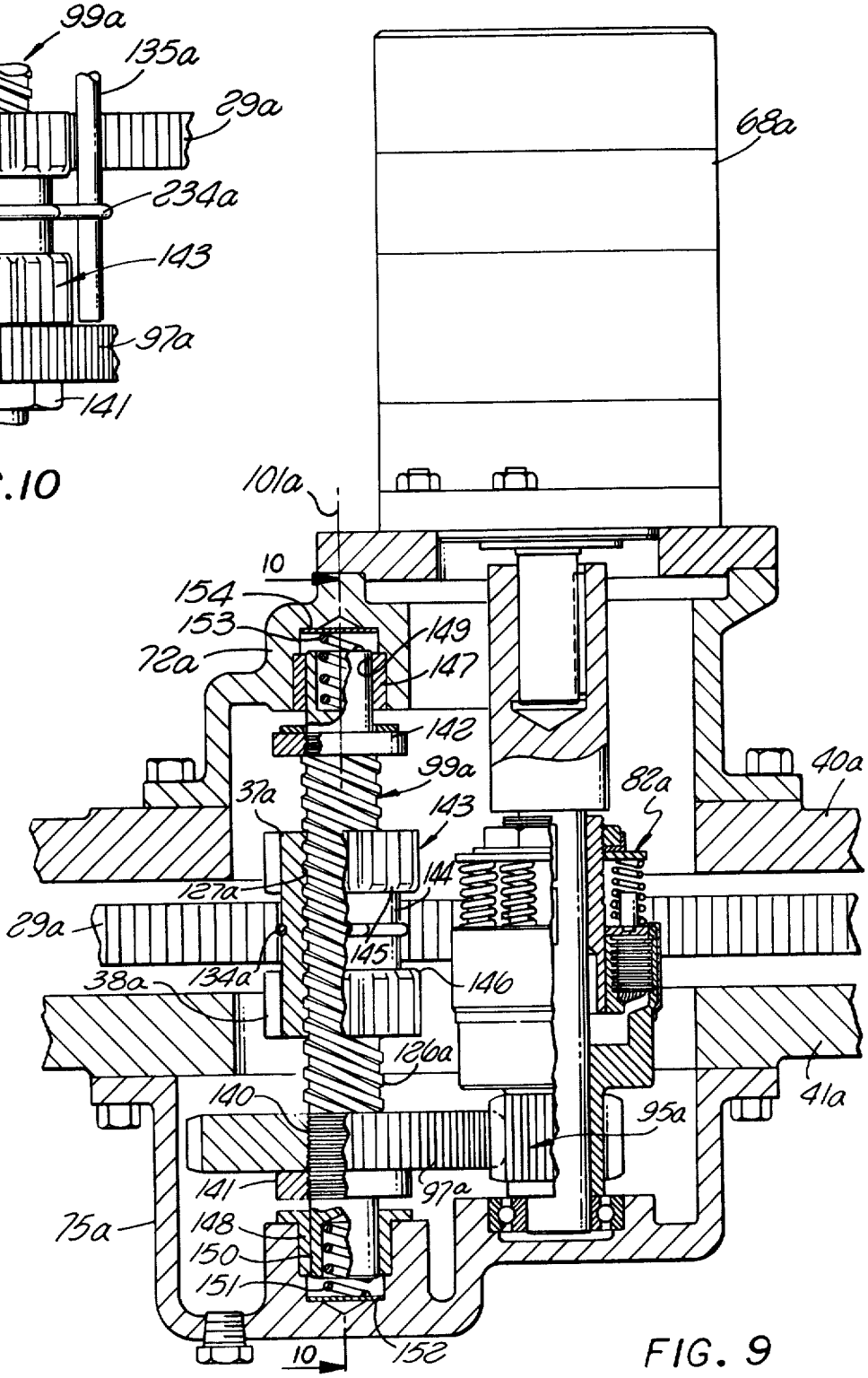
FIG. 9 is a view similar to FIG. 4 but showing a variational form of the invention.

FIGS. 9 and 10 show a variational form of the invention in which a single lead screw or shaft **99*a* is substituted for the two screws 98 and 99 of the first form of the invention, with both of the drive gears 37*a* and 38*a* being mounted about and threadedly connected to the common shaft 99*a*. Ring gear 29*a* of FIGS. 9 and 10 corresponds to and may be constructed the same as gear 29 of the first form of the invention, being disposed about and rigidly connected to a tubular part corresponding to that shown at 23 in FIG. 3. The body of the tool of FIGS. 9 and 10 is formed of a number of rigidly interconnected sections 40*a*, 41*a*, 72*a* and 75*a* corresponding essentially to sections 40, 41, 72 and 75 of FIG. 4, and defining a hollow internal space within which the drive parts are contained. Motor 68*a* acts through slip clutch 82*a* to rotate a pinion gear 95*a*, which in turn meshes with and drives a gear 97*a* rigidly connected to the lower end of lead screw 99*a*. This attachment between gear 97*a* and screw 99*a* may be effected by connecting the gear onto the lower end of the shaft threadedly as represented at 140, with a nut 141 acting to lock the gear on the shaft and upwardly against the lower extremities of its lead screw threads 126*a*. A stop ring 142** is similarly threaded on the upper end of the screw.

The two gears **37*a* and 38*a* may be rigidly connected together for rotary and axial movement along screw 99*a*, and more particularly may be portions of a single rigid unitary structure 143, having enlarged diameter portions at its opposite ends forming the two gears 37*a* and 38*a*, and having a reduced diameter typically externally cylindrical portion 144 intermediate the two gears and of a diameter to avoid contact with the driven ring gear 29*a*. Part 143 has internal threads 127*a* corresponding to and threadedly engaging the external threads of screw shaft 99*a* to mount the gears for upward and downward movement along the shaft. In the FIG. 9 position of the gear unit 143, upper gear 37*a* is received above the level of gear 29*a* and out of engagement therewith, and lower gear 38*a* is received beneath gear 29*a* and out of engagement therewith, with the intermediate unthreaded reduced diameter portion 144 of part 143 received opposite gear 29*a*, so that the gear 29*a* and the connected tube corresponding to part 23 of FIG. 3 can rotate freely without rotation of gears 37*a* and 38*a* or any of the other drive elements including the motor and slip clutch. Part 143 is movable downwardly along screw 99*a* by clockwise rotation of the screw as viewed looking downwardly along axis 101*a*. This downward movement of part 143 is halted in the FIG. 10 position by engagement of part 143 with gear 97*a*. In that position, continued clockwise rotation of screw 99*a* acts to drive unit 143 with the screw by virtue of the engagement between parts 143 and 97*a*, and the upper gear 37*a* of part 143 engages gear 29*a* to drive it and the connected tubular central stem of the device rotatively. Similarly, counterclockwise rotation of shaft 99*a* as viewed looking downwardly along axis 101*a* causes upward movement of part 143 to a position in which its lower gear portion 38*a* engages and drives ring gear 29*a*. The lower leading ends 145 of the teeth of gear 37*a*, and the upper leading ends 146 of the teeth of gear 38*a*, may be tapered or rounded as shown to facilitate their movement into proper meshing engagement with the teeth of ring gear 29*a*. To further assure proper engagement of the gear teeth, shaft 99*a* is mounted for limited upward and downward movement along axis 101*a* from the FIG. 9 position. For this purpose, the upper and lower ends of the shaft are journalled within sleeve bearings 147 and 148 carried by the body of the tool, and have outer cylindrical surfaces 149 and 150 longer than the bearings to enable downward movement of the shaft against the tendency of a spring 151 bearing against a disc 152 and upward movement against the tendency of a spring 153 bearing against disc 154. Rotation of the gear unit 143 relative to the shaft is resisted by a friction ring 134***a* having a loop 234*a* engaging and movable axially along a pin 135*a*. Element 134*a* thus functions in the manner of friction elements 114 and 134 of the first form of the invention to supplement the inertia effect of the gears and assure axial displacement of element 143 either upwardly or downwardly to one of its extreme positions upon rotation of screw 99*a* in a corresponding direction. The upward movement of the drive gear unit 143 is limited by engagement of that unit with stop ring 142.

Figure 3:
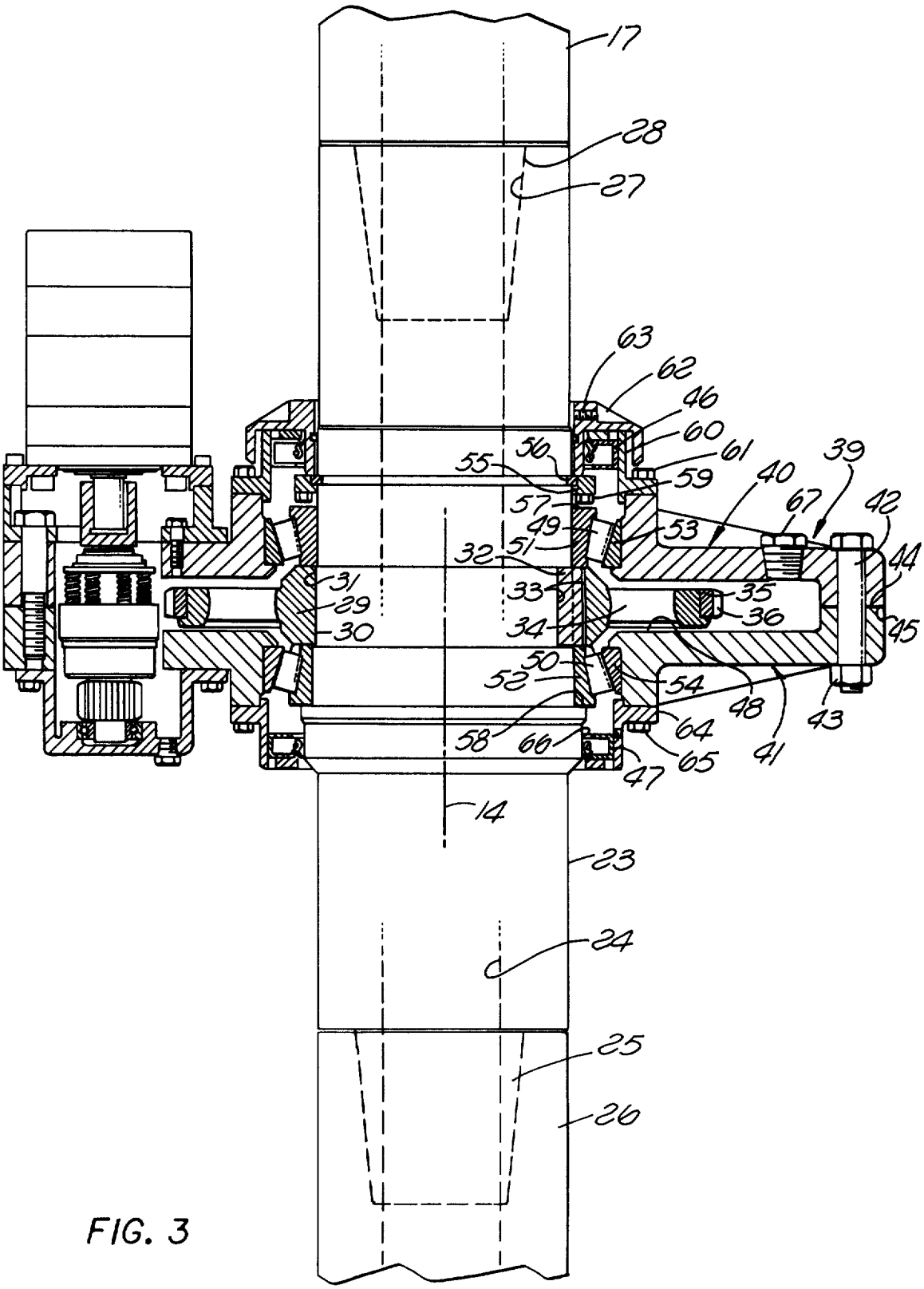
FIG. 3 is an enlarged central vertical axial section taken on line 3—3 of FIG. 1.

When the tool of FIGS. 9 and 10 is in use, the kelly and connected swivel stem and tube corresponding to element 23 of FIG. 3 can be rotated freely by the rotary table when the gear unit 143 is in the central non-driving position of FIG. 9. If the motor is energized to rotate shaft 99*a* in a clockwise direction as viewed looking downwardly along axis 101*a*, gear unit 143 is actuated downwardly to bring gear 37*a* into engagement with gear 29*a* and drive the central tubular stem of the tool in a first direction. Similarly, rotation of the shaft in the opposite direction moves element 143 upwardly to bring gear 38*a* into engagement with gear 29*a* and drive the ring gear and central tubular stem in the opposite direction. The motor can thus drive the stem in either direction, and in a central neutral position of gear unit 143 breaks the drive from the motor and slip clutch to the ring gear 29*a* allowing rotation of the kelly by the rotary table without rotation of or adverse effect on the motor and connected gears.

While certain specific embodiments of the present invention have been disclosed as typical, the invention is of course not limited to these particular forms, but rather is applicable broadly to all such variations as fall within the scope of the appended claims.

We claim:

1. A spinner comprising:

a tubular member adapted to be connected to the upper end of a kelly or the like and containing a passage through which drilling fluid flows downwardly;

a reversible motor having a rotor which is power driven in opposite directions; and a drive for transmitting power from said motor to said tubular member and including two gears driven by the motor and operable to drive said member in opposite directions respectively;

said drive including threaded connection means mounting said gears for axial movement and operable upon rotation of said rotor in one direction to shift a first of the gears axially from a retracted non-driving position to an active position engaging a coacting gear and driving said member in a first direction, and to exert force axially against the second of said gears in the direction of a retracted non-driving position thereof;

said threaded connection means being operable upon rotation of said rotor in its opposite direction to shift said second gear axially from said retracted non-driving position to an active position engaging a coacting gear and driving said member in its second direction, and to exert force axially against said first gear in the direction of said retracted position thereof.

2. A spinner as recited in claim 1, including a body supported by said tubular member and relative to which said member is rotatable, and means supporting said motor and said gears and said threaded connection means from said body.

3. A spinner as recited in claim 1, in which said drive includes a slip clutch between said motor and said gears.

4. A spinner as recited in claim 1, in which said threaded connection means include two separate shafts driven rotatively by said motor and having external threads engaging internal threads in said gears to shift the gears actually in response to rotation of the shafts.

5. A spinner as recited in claim 1, including spring means yieldingly urging both of said gears to said retracted non-driving positions thereof.

6. A spinner as recited in claim 1, in which said threaded connections means include right-hand threads mounting one of said gears for said axial movement and left-hand threads mounting the other gear for axial movement.

7. A spinner as recited in claim 1, in which said drive includes a ring gear extending about and adapted to drive said tubular member and driven in opposite directions by said two first mentioned gears respectively.

8. A spinner as recited in claim 1, including a body extending about said tubular member, bearing means supporting said body from said tubular member and enabling rotation of the tubular member relative to the body, said drive including a ring gear disposed about said tubular member within said body and connected to the tubular member to drive it rotatively, said threaded connection means including two shafts mounted by said body for rotation about different axes and having external threads engaging internal threads within the gears respectively to actuate the gears axially between said active and retracted positions.

9. A spinner as recited in claim 8, including springs yieldingly urging said gears axially toward said retracted positions thereof.

10. A spinner as recited in claim 1, including means for frictionally resisting rotation of said first and second gears to assure said axial shifting movement thereof.

11. A spinner as recited in claim 1, including friction spring elements extending about said first and second gears and engagable frictionally therewith in a relation resisting rotation thereof and assuring said axial shifting movement thereof, and means retaining said friction spring elements against rotation.

12. A spinner as recited in claim 1, including friction spring elements extending about said first and second gears and engagable frictionally therewith in a relation resisting rotation thereof and assuring said axial shifting movement thereof, and elongated pins received within loop portions of said friction spring elements to retain them against rotation, said friction spring elements being received within grooves in the outer surfaces of said first and second gears.

13. A spinner as recited in claim 10, including two coil springs disposed about said two shafts respectively and urging said two drive gears axially to said retracted positions thereof.

14. A spinner as recited in claim 13, including two resilient friction spring elements disposed about said drive gears and urged radially inwardly thereagainst to frictionally resist rotation of the drive gears and assure said axial shifting movement thereof, and axially extending pins carried by said body and engaging said friction spring elements in different positions of the drive gears to prevent rotation of said friction spring elements.

15. A spinner comprising:

a tubular member having threads connectible to a well drilling kelly or the like and containing a passage through which drilling fluid flows downwardly;

a hollow body disposed about said tubular member;

bearing means supporting said body from said tubular member and enabling rotation of the tubular member relative to the body;

a ring gear extending about said member within said body and connected to said member to drive it rotatively;

a reversible motor supported by said body and having a rotor which is power driven in opposite directions;

two shafts driven rotatively by said rotor and having right-hand and left-hand threads respectively;

two drive gears carried about and driven by said shafts respectively and engageable selectively with said ring gear to drive it and said member in opposite directions;

said drive gears having right-hand and left-hand threads respectively engaging said right-hand and left-hand threads of said shafts in a relation acting upon rotation of said rotor in one direction to shift a first of said drive gears axially along the coacting shaft from a retracted non-driving position to an active position engaging said ring gear and driving it and said tubular member in a first direction, and to actuate the second of said drive gears to or retain it in a retracted non-driving position out of engagement with said ring gear;

said threads of the shafts and drive gears acting upon rotation of said rotor in its opposite direction to shift said second drive gear axially from said non-driving position to an active position engaging said ring gear and driving it in its second direction, and to actuate said first drive gear to or retain it in said retracted position thereof out of engagement with the ring gear.

16. The combination comprising:

a member to be driven rotatively;

a reversible motor having a rotor which is power driven in opposite directions; and a drive for transmitting power from said motor to said member and including two drive gears driven by the motor and operable to drive said member in opposite directions respectively;

said drive including threaded connection means mounting said gears for axial movement and operable upon rotation of said rotor in one direction to shift a first of the gears axially from a retracted non-driving position to an active position engaging a coacting gear and driving said member in a first direction, and to exert force axially against the second of said drive gears in the direction of a retracted non-driving position thereof;

said threaded connection means being operable upon rotation of said rotor in its opposite direction to shift said second drive gear axially from said retracted non-driving position to an active position engaging a coacting gear and driving said member in its second direction, and to exert force axially against said first drive gear in the direction of said retracted non-driving position thereof.

17. The combination as recited in claim 16, in which said threaded connection means include two shafts driven rotatively by said rotor and having external threads engaging internal threads of said gears respectively to shift the gears axially between said positions thereof.

18. The combination as recited in claim 16, in which said threaded connection means include a common threaded element to which both of said gears are threadedly connected for limited relative rotary and axial movement and operable upon rotation in one direction to urge both of said drive gears in a first axial direction to drive through one of the gears and upon rotation in the opposite direction to urge both drive gears in the opposite axial direction to drive through the other gear.

19. The combination as recited in claim 18, in which said drive gears are both simultaneously receivable in said nondriving positions when said element is undriven by said motor.

20. The combination as recited in claim 16, in which said threaded connection means include right-hand threads mounting one of said gears and left-hand threads mounting the other of said gears.

21. The combination as recited in claim 16, including spring means yieldingly urging said gears to said retracted nondriving positions thereof.

22. The combination as recited in claim 16, including means frictionally resisting rotation of said first and second gears to assure said axial shifting movement thereof.

23. The combination as recited in claim 16, in which said drive includes an additional gear connected to said member to drive it rotatively and adapted to be driven in opposite directions by said two first mentioned gears respectively, said threaded connection means including two shafts driven by said rotor and having external threads engaging internal threads of said two first mentioned gears respectively to shift them between said positions thereof.

24. The combination as recited in claim 23, in which said threads of one of said shafts and the coacting gear are right-hand threads and the threads of the other shaft and gear are left-hand threads.

25. A well pipe spinner comprising:

a tubular member adapted to be connected to the upper end of a kelly or the like and containing a passage through which drilling fluid flows downwardly;

a reversible motor having a rotor which is power driven in opposite directions; and a drive for transmitting power from said motor to said tubular member and including two drive gears for turning said member in opposite directions respectively;

said drive including a threaded element driven by said rotor and to which both of said gears are threadedly connected for limited relative rotary and axial movement and operable upon rotation in one direction to exert force against both of said gears in a first axial direction and to engage a first of said drive gears with a coacting gear in a relation driving said member in a first direction while the second gear is in a retracted non-driving position;

said threaded element being operable upon rotation in the opposite direction to exert force against both of said drive gears in a second axial direction and engage the second drive gear with a coacting gear in a relation driving said member in its second direction while the first drive gear is in a retracted position.

26. A well pipe spinner as recited in claim 25, in which said threaded element is a shaft having an external thread engageable with internal threads of said drive gears.

27. A well pipe spinner as recited in claim 25, in which said two drive gears are connected rigidly together for rotary and axial movement as a unit relative to said threaded element.

28. A well pipe spinner as recited in claim 25, including means frictionally resisting rotation of said drive gears relative to said threaded element.

29. A well pipe spinner as recited in claim 25, in which said two drive gears in their non-driving positions are received at opposite sides of a single coacting gear, and are movable selectively into engagement with that gear in their driving positions.

30. A well pipe spinner as recited in claim 25, in which said threaded element is a screw having an external thread, said two drive gears being rigidly connected together and part of a unitary structure having an external thread engaging said external thread of said screw, said unitary structure having a reduced diameter portion intermediate said two drive gears and being movable axially relative to said screw between a central position in which said reduced diameter portion of said structure is opposite a coacting gear and said two drive gears are at opposite axial sides thereof and out of engagement with said coacting gear, and positions displaced in opposite axial directions from said central position and in which said two drive gears respectively are in engagement with said single coacting gear.

31. A well pipe spinner as recited in claim 30, including a friction element movable axially with and frictionally engaging said reduced diameter portion of said unitary structure and retained against rotation therewith and frictionally resisting rotation of said structure with said screw.

32. A well pipe spinner as recited in claim 31, in which said screw is free for limited axial movement relative to said coacting gear to assist in assuring meshing engagement between said drive gears and said coacting gear.

* * * * *